US012601337B2

(12) United States Patent
Love et al.

(10) Patent No.: US 12,601,337 B2
(45) Date of Patent: Apr. 14, 2026

(54) PIEZO-ELECTRIC FLUID PUMP

(71) Applicant: SAFRAN LANDING SYSTEMS UK LTD., Gloucester (GB)

(72) Inventors: Tom Love, Gloucester (GB); Andrew Plummer, Bath (GB); Nathan Sell, Bath (GB); Roy Evans, Gloucester (GB)

(73) Assignee: SAFRAN LANDING SYSTEMS UK LTD., Gloucester (GB)

( * ) Notice: Subject to any disclaimer, the term of this patent is extended or adjusted under 35 U.S.C. 154(b) by 0 days.

(21) Appl. No.: 18/570,582

(22) PCT Filed: Jun. 17, 2022

(86) PCT No.: PCT/EP2022/066554

§ 371 (c)(1),
(2) Date: Dec. 14, 2023

(87) PCT Pub. No.: WO2022/263628

PCT Pub. Date: Dec. 22, 2022

(65) Prior Publication Data

US 2024/0280092 A1 Aug. 22, 2024

(30) Foreign Application Priority Data

Jun. 17, 2021 (EP) ..... 21180101

(51) Int. Cl.
*F04B 17/00* (2006.01)

(52) U.S. Cl.
CPC ..... *F04B 17/003* (2013.01)

(58) Field of Classification Search
CPC ..... F04B 17/003
(Continued)

(56) References Cited

U.S. PATENT DOCUMENTS 1,310,146 A * 7/1919 Schneider ..... F41A 23/28 280/43.23
3,391,680 A 7/1968 Benson
(Continued)

FOREIGN PATENT DOCUMENTS

DE 10318391 A1 11/2004
DE 102007030043 A1 1/2009

OTHER PUBLICATIONS

Communication about intention to grant a European patent received for European Application No. 21180101.4, mailed on Oct. 2, 2023, 6 pages.

(Continued)

*Primary Examiner* — Connor J Tremarche
(74) *Attorney, Agent, or Firm* — WOMBLE BOND DICKINSON (US) LLP

(57) ABSTRACT

A piezo-electric fluid pump is provided including a main housing; a fluid reservoir located within the main housing; a piston head moveably mounted within the main housing; a piezo-electric stack; a bias mechanism arranged to couple the piston head and piezo-electric stack and maintain the piezo-electric stack in compression; an outlet plate statically mounted within the main housing adjacent to the piston head, wherein the adjacent surfaces of the outlet plate and piston head define a pumping chamber; an inlet disc valve arranged to permit a one-way flow of fluid from the reservoir into the pumping chamber; and an outlet disc valve arranged to permit a one-way flow of fluid out of the pumping chamber. The combination of pre-loading of the piezo-electric stack in compression and use of inlet disc valve enables the piezo-electric pump to exhibit substantial improvement to the pressure and flow capability compared to other piezo-electric pumps.

12 Claims, 5 Drawing Sheets

(58) Field of Classification Search
USPC ..... 417/321
See application file for complete search history.

(56) References Cited

U.S. PATENT DOCUMENTS

| | | | | |
|---|---|---|---|---|
| 3,461,910 | A | 8/1969 | Selsam et al. | |
| 4,471,256 | A * | 9/1984 | Igashira | H10N 30/874 239/584 |
| 6,186,118 | B1 * | 2/2001 | Spakowski | F02M 59/02 123/456 |
| 6,712,289 | B1 * | 3/2004 | Ruehle | F02M 61/167 239/533.9 |
| 7,322,804 | B2 * | 1/2008 | Humburg | F04B 13/00 417/525 |
| 2009/0311116 | A1 | 12/2009 | Bai et al. | |

OTHER PUBLICATIONS

European Search Report and Search Opinion received for European Application No. 21180101.4, mailed on Dec. 16, 2021, 9 pages.
International Search Report and Written Opinion received for PCT Patent Application No. PCT/EP2022/066554, mailed on Sep. 22, 2022, 11 pages.

* cited by examiner

PIEZO-ELECTRIC FLUID PUMP

BACKGROUND

This application relates to an improved design for a piezo-electric fluid pump which may, for example, be used as a hydraulic pump in aircraft systems.

Other than small personal aircraft, present day aircraft have a number of hydraulically operated systems, such as wing flap actuators and landing gear actuators. To date a central hydraulic pump is provided to provide a supply of pressurised hydraulic fluid to each system. Each system may have its own dedicated pump, or multiple pumps, or alternatively all the hydraulic systems are serviced by the same pump(s). This centralised arrangement has a number of disadvantages, such as weight and the number of components (hydraulic pipes, connectors and valves for example) subject to wear.

To mitigate against the disadvantages of a centralised hydraulic system for aircraft it is possible to make use of electro-hydraulic actuators (EHA), in which each actuator has its own associated, often integrated, electrically driven hydraulic pump. Distributing power around the aircraft to each of the actuators electrically rather than hydraulically brings with it a reduction in weight and a reduction in the number of components.

A conventional electro-hydraulic actuator includes a hydraulic pump driven by a separate electric motor. These separate components can be replaced by piezo-electric pump, thereby bringing about a further reduction in weight and the number of components prone to wear. The basic principle of a piezo-electric pump is that a stack of piezo-electric elements are driven by an alternating current, thus causing the stack to alternatively expand and contract in a reciprocating motion, which in turn can cause the volume of a fluid pumping chamber to alternatively increase and decrease, thus causing a volume of fluid to be pumped in and out of the chamber.

However, piezo-electric pumps typically have low pressure and low flow rate capabilities, which are undesirable for use in electro-hydraulic actuators for aircraft applications.

SUMMARY OF THE INVENTION

A piezo-electric pump is provided comprising: a main housing; a fluid reservoir located within the main housing; a piston head moveably mounted within the main housing; a piezo-electric stack; a bias mechanism arranged to couple the piston head and piezo-electric stack and maintain the piezo-electric stack in compression; an outlet plate statically mounted within the main housing adjacent to the piston head, wherein the adjacent surfaces of the outlet plate and piston head define a pumping chamber; an inlet disc valve arranged to permit a one-way flow of fluid from the reservoir into the pumping chamber; and an outlet disc valve arranged to permit a one-way flow of fluid out of the pumping chamber.

The combination of pre-loading of the piezo-electric stack in compression and use of inlet disc valve enables the piezo-electric pump described above to exhibit substantial improvement to the pressure and flow capability compared to other piezo-electric pumps.

The piezo-electric stack may be located between the piston head and a base plate and the bias mechanism may comprise a spring element arranged to exert a force biasing the piston head and base plate towards each other.

Maintaining the piezo-electric stack in compression has the advantage of avoiding undesirable tensile loads being applied to the stack in operation.

A piston rod may be coupled to the piston head and the piston rod extends from the piston head through the reservoir and the base plate and is coupled to the base plate. The piston rod may be coupled to the base plate by one or more retaining elements and the spring element is located between the retaining elements and the base plate. The spring element may comprise one or more Belleville washers.

Alternatively, the spring element may be arranged around the outside of the piezo-electric stack and is coupled to the piston head and the base plate.

The piezo-electric stack may include an internal void that comprises the fluid reservoir. This has the advantage of the pumping fluid within the reservoir acting as a coolant to prevent excessive heat build-up in the piezo-electric stack.

The piezo-electric pump may further include a fluid inlet port in fluid communication with the fluid reservoir.

One or more fluid inlet passages may be formed in the piston head providing fluid communication between the fluid reservoir and the pumping chamber and the inlet disc valve is arranged to prevent fluid flow from the pumping chamber into the fluid inlet passages.

Similarly, the one or more fluid outlet passages may be formed in the outlet plate providing fluid communication out of the pumping chamber into a fluid outlet chamber and the outlet disc valve is arranged to prevent fluid flow from the fluid outlet chamber into the fluid outlet passages.

DETAILED DESCRIPTION

Piezo pumps have the aforementioned benefit of reducing the number of components and the wearing surfaces of a traditional EHA solution. However to compete with a traditional EHA, there needs to be a substantial improvement in the pressure and flow capability. However, increasing the pressure and flow capability of a piezo-electric pump requires a number of challenges to be addressed.

The high frequency operation required to accumulate very small pumped volumes into appreciable flows results in the need for responsive valves controlling the flow of the pumped fluid into and out of the pumping chamber capable of operating at such high frequencies. Operating a piezo-electric stack at high frequencies generates a significant amount of heat in the stack, thereby requiring increased heat dissipation from the piezo stack. Also, the piezo-electric material making up the individual elements of a piezo-electric stack has significantly less ability to resist tensile loads than compression loads. Unless mitigated against, operating the piezo stack at high frequencies can result in high tensile loads being applied to the stack and a method of preloading the piezo stack to ensure tensile loads on the piezo stack are limited is therefore desirable.

Hydraulic fluid will exhibit some degree of compressibility, albeit small. This will arise, for example, from entrained air in the oil and inherent properties of the hydraulic fluid. Consequently, because the magnitude of motion provided by piezo-electric elements is small, the volume of the pumping chamber must be minimised to ensure that compressibility effects do not reduce the overall pressure capability of the pump.

As with all pumps, sealing of the pumping chamber is important to ensure that lost flow is minimised.

Integration of the pump to accommodate high frequency valves, methods of preloading and sealing whilst maintaining the required low pump chamber volumes all present technical problems that need to be addressed.

Figure 1:
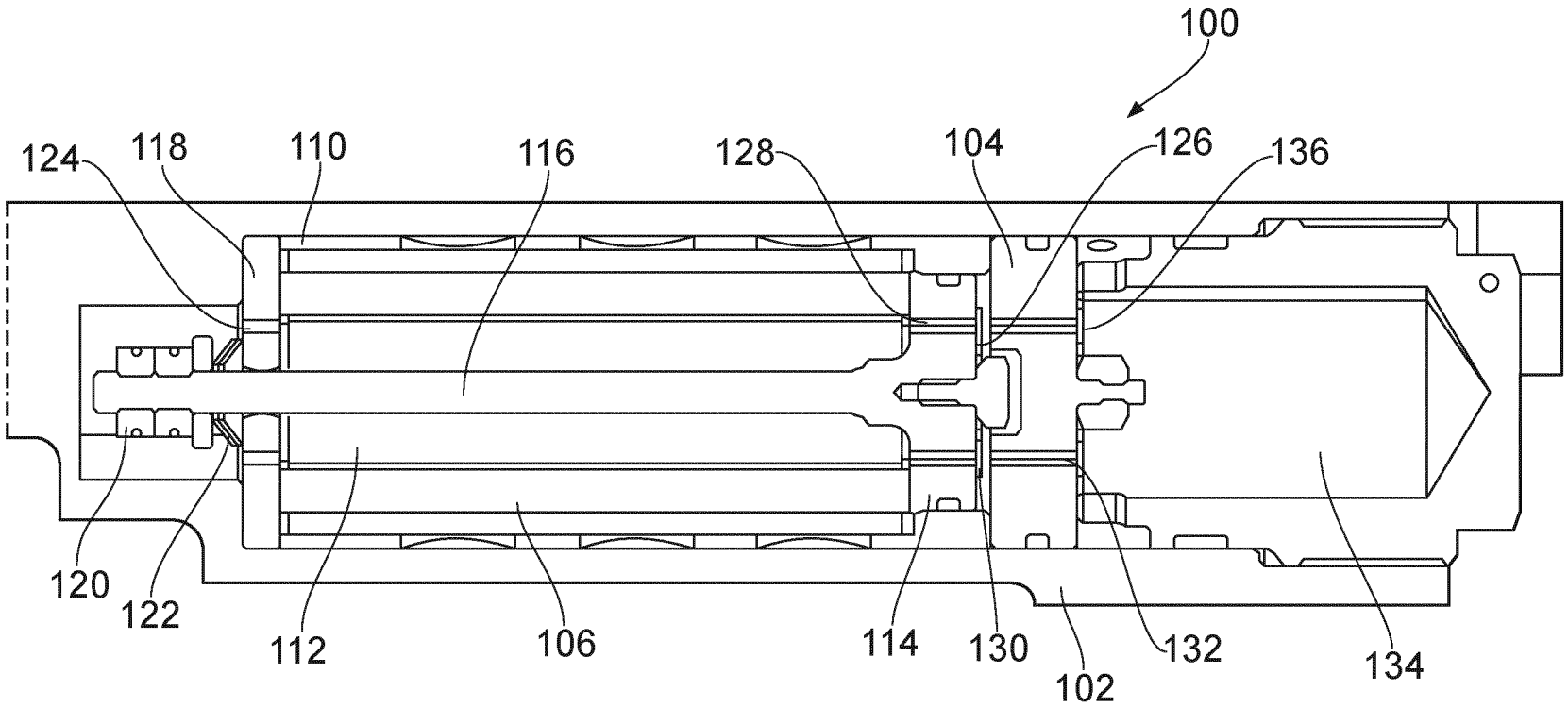
FIG. 1 illustrates a cross section of a piezo-electric pump.

FIG. 1 illustrates a cross-section of a piezo-electric pump according to an embodiment of the present invention. The pump 100 includes a main housing 102. An outlet plate 104 is located within the interior of the main housing in such a manner that the outlet plate is not movable with respect to the housing. The outlet plate 104 divides the interior of the main housing 102 into two portions. On a first side of the outlet plate 104 (the left hand side as shown in FIG. 1) a stack of piezo-electric elements is located. The piezo-electric stack 106 is configured such that when driven by an appropriate electric signal the stack 106 can reciprocate within the main housing 102. In preferred embodiments the piezo-electric stack is substantially cylindrical, but other geometries may be utilised. In the particular embodiment illustrated in FIG. 1 the stack 106 has an outer sheath of low friction material that is arranged to slide against a stack liner 110 together with movement of the piezo-electric stack. The outer sheath and stack liner 110 in combination keep the piezo-electric stack 106 centred with the main housing 102, while the stack liner 110 also functions define the height (horizontal length as illustrated) of the chamber within which the piezo-electric stack is located. However, in other embodiments the outer sheath and/or stack liner may be omitted.

The Piezo-electric stack 106 is hollow, i.e. it is formed with an internal void 112. The void allows the pumped fluid to flow through the piezo-electric stack 106. Located between the piezo-electric stack 106 and the outlet plate 104 is a piston head 114. A piston rod (or tie rod) 116 extends from the piston head through the interior void of the piezo-electric stack and passes through a base plate 118 of the stack. The base plate 118 is arranged to be fixed relative to the main housing 102. The piston rod 116 is arranged to reciprocate with the piezo-electric stack through the base plate. The end of the piston rod 116 that protrudes beyond the base plate 118 within the housing 102 has one or more nuts 120 threaded onto it. One or more resilient elements 122, such as Belleville washers, are secured by the nuts between the nuts 120 and the base plate 118. The resilient elements 122 are held in compression against the base plate 118 by the nuts, and as a consequence exert a bias force through the piston rod and piston head to piezo-electric stack 106. This bias force provides a preloading to the piezo-electric stack such that the stack is permanently held in compression.

The base plate 118 has one or more fluid passages 124 formed in it that allow a flow of fluid into the void 112 within the piezo-electric stack 106. A fluid supply is provided, in use, to an inlet port in the main housing (not illustrated).

The space between the opposing faces of the piston head 114 and outlet plate 104 constitute a pumping chamber 126 (more easily seen in the subsequent figures). The piston head 114 includes one or more fluid inlet passages 128 that provide fluid communication between the internal void 112 of the piezo-electric stack and the pumping chamber 126. An inlet disc valve 130 is secured to the face of the piston head defining the pumping chamber and is arranged to control flow of the pumping fluid through the fluid inlet passages 128 from the void 112 into the pumping chamber 126. The outlet plate 104 also includes one or more fluid outlet passages 132 that provide fluid communication between the pumping chamber 126 and a fluid outlet chamber 134 of the pump 100 from which, in use, pressurised fluid is provided. An outlet disc valve 136 is secured to the face of the outlet plate 104 of the opposing face to that defining the pumping chamber, i.e. the face of the outlet plate adjacent to the fluid outlet chamber 134. The outlet disc valve 136 is arranged to control flow of the pumping fluid through the fluid outlet passages 132 from the pumping chamber 126 into the fluid outlet chamber 134.

The operation of the pump 100 will now be described with reference to FIGS. 2-5 which illustrate an enlarged portion of the pump illustrated in FIG. 1.

Figure 2:
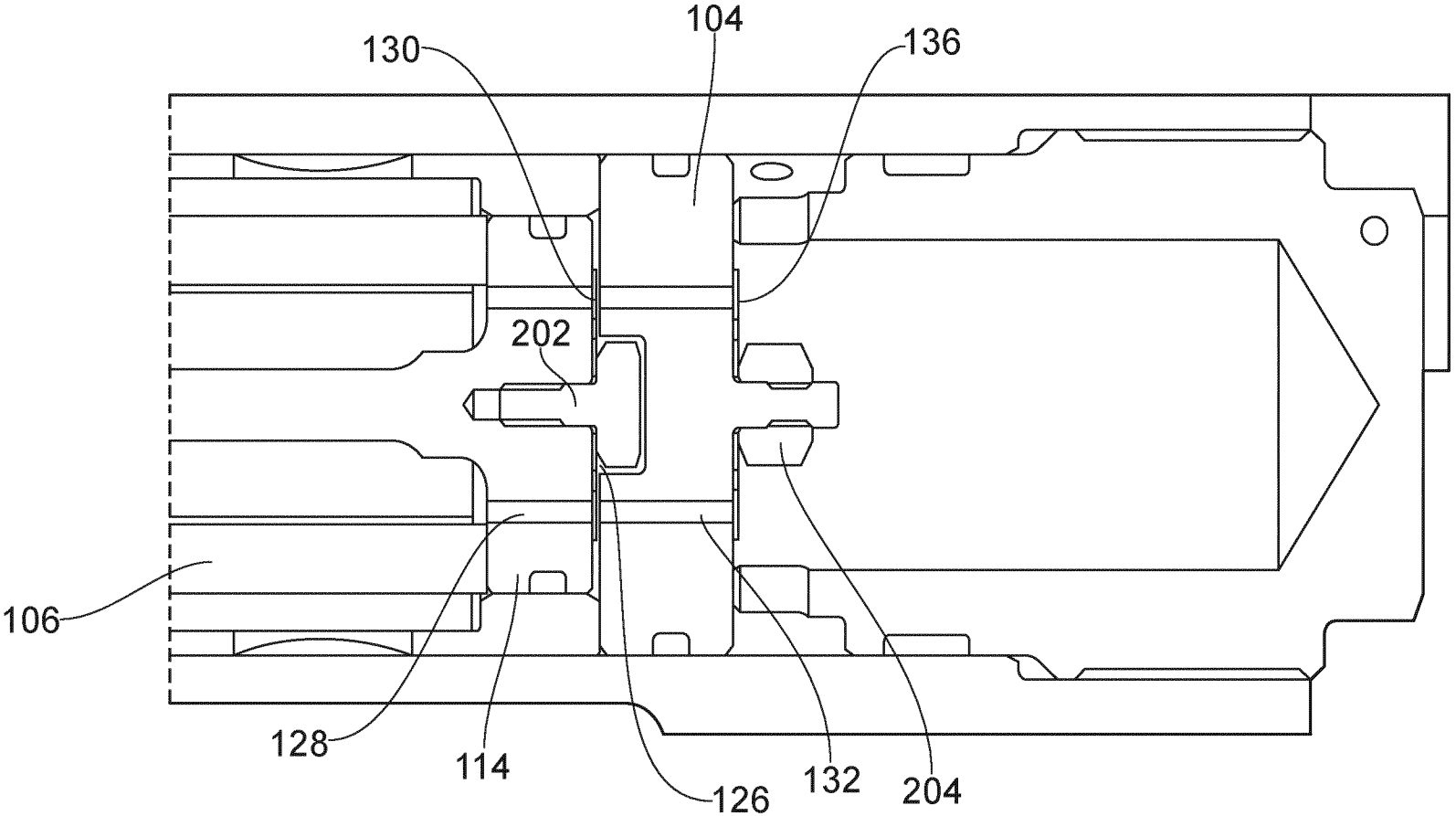
FIGS. 2-5 illustrate an enlarged portion of the pump of FIG. 1 at different points in a pumping cycle.

FIG. 2 shows an enlarged view of a portion of the piezo-electric pump illustrated in FIG. 1, centred about the pumping chamber 126. FIG. 2 represents the pump 100 at a point in the pumping cycle when the piezo-electric stack 106 is fully extended and therefore the piston head 114 is at its closest point to the outlet plate 104. As a consequence, the volume of the pumping chamber 126 is at its minimum. The inlet and outlet disc valves 130, 136 can be more easily seen in FIG. 2. In the illustrated embodiment, both disc valves comprise a planar annulus of resilient material, such as spring steel. The inlet disc valve 130 is secured about a central portion to the piston head 114 by means of a retaining screw 202, or other suitable retaining mechanism. The inlet disc valve extends radially from its centre a sufficient distance to extend over each of the inlet fluid passages 128. The action of the retaining screw and the resilient property of the disc valve material causes the inlet disc valve to be biased against the piston head 114 and seal the inlet fluid passage 128 from the pumping chamber 126. The outlet disc valve 136 is secured in a similar manner to the outlet plate 104, albeit using a retaining nut 204. The outlet disc valve also extends radially so as to extend over each of the outlet fluid passages 132 and is biased against the outlet plate in order to seal the outlet fluid passage from the fluid outlet chamber 134. The disc valves may also have additional 'damping' holes formed in them to allow fluid to effectively flow through the valve when open as well as flow around the valve. Such damping holes allow fluid to pass through the valve as it closes, but would be positioned in the disc valves so as to seal against the piston head 114 or outlet plate 104 when the valve is closed. The disc valves may also include an additional spring, such as a second disc of spring steel of smaller diameter, so as to stiffen the inner portion of the main valve body. In FIG. 2 the inlet and outlet disc valves are illustrated as both being closed and therefore sealing their associated fluid passages such that there is no fluid flow though the pump. However, it will be appreciated that the opening and closing of the disc valves is dependent on factors such as spring stiffness, mass, and frequency of pump operation, rather than any direct correlation with the position of the piezo-electric stack.

Figure 3:
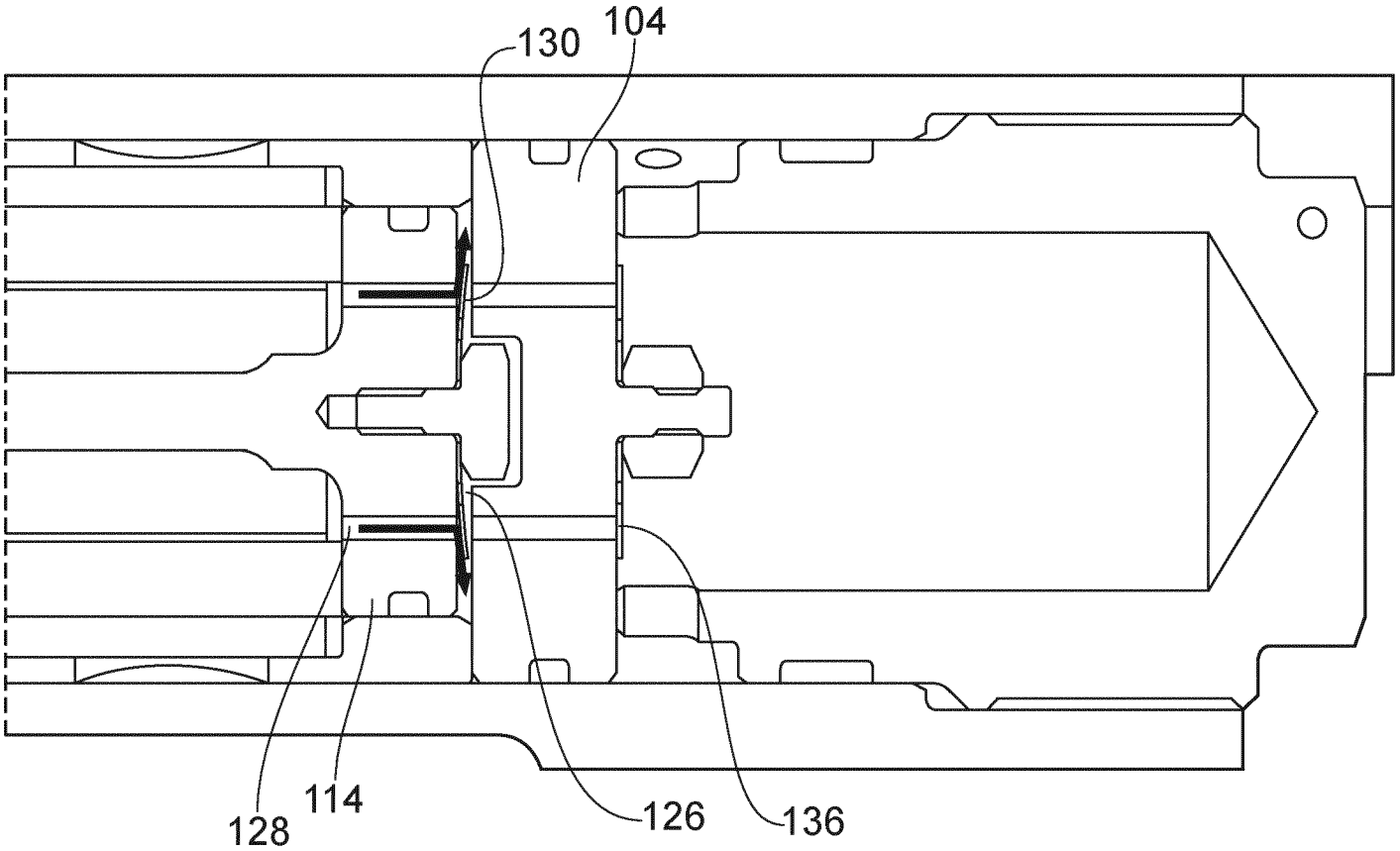

FIG. 3 represents the pump 100 when the piezo-electric stack 106 is partially retracted, part-way through an inlet stroke of the pump. The relative movement of the piston head 114 towards the base plate 118 increases the volume of the pumping chamber, reducing the pressure within the chamber. The pressure difference between fluid within the internal void 112 and the lower pressure in the pumping chamber is sufficient to overcome the bias force of the inlet disc valve 130, as illustrated, allowing the fluid to flow through inlet passages 128, past the deformed disc valve and into the pumping chamber 126. For at least a period of the inlet stroke the outlet disc valve 136 will be closed, as illustrated in FIG. 3.

Figure 4:
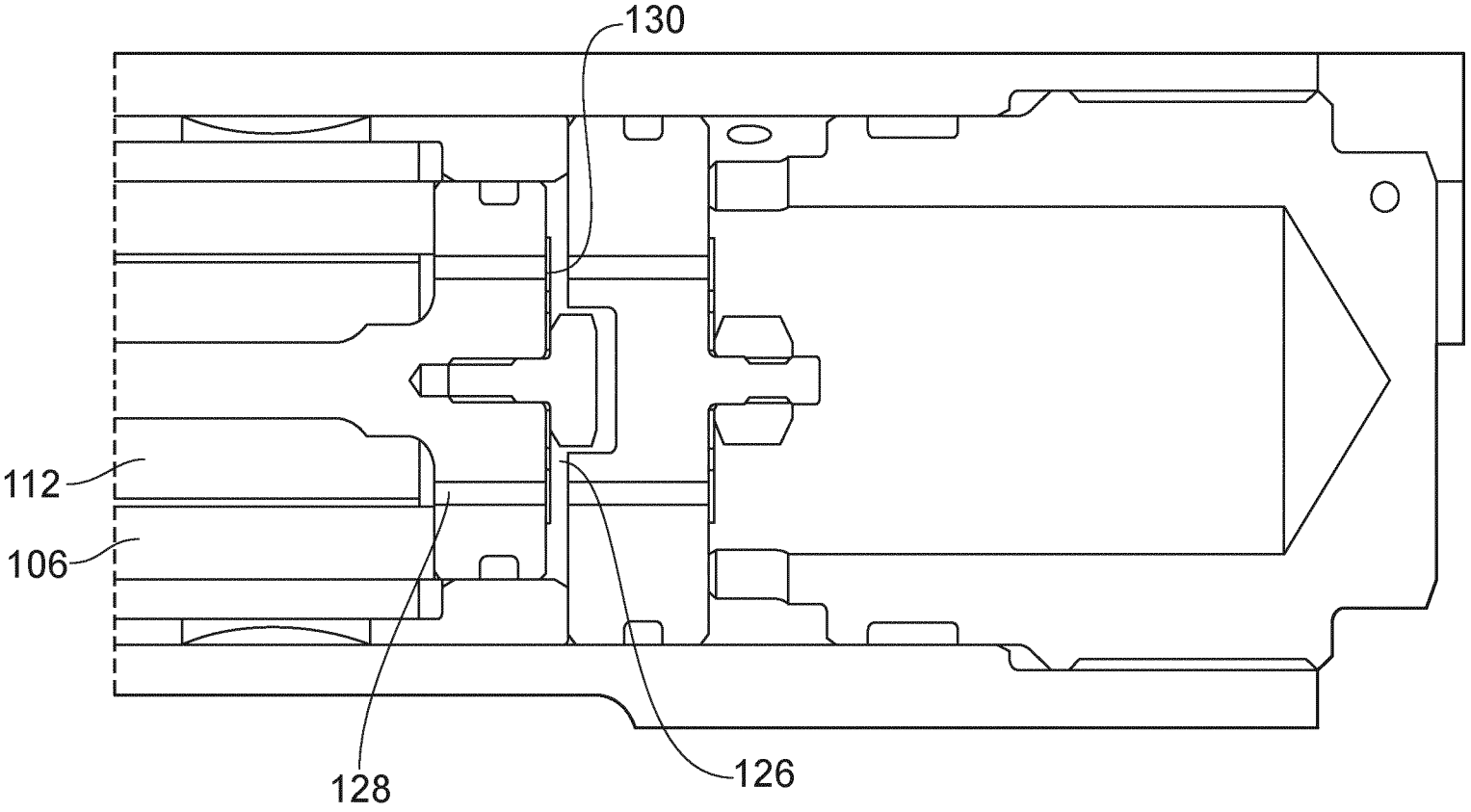

FIG. 4 illustrates the pump 100 with the piezo-electric stack 106 fully retracted (compressed). In this position there is no flow of the pumping fluid through the inlet passages 128 into the pumping chamber 126 and consequently the bias force of the inlet disc valve 130 is sufficient to return the valve to its natural position flat against the piston head 104.

Figure 5:
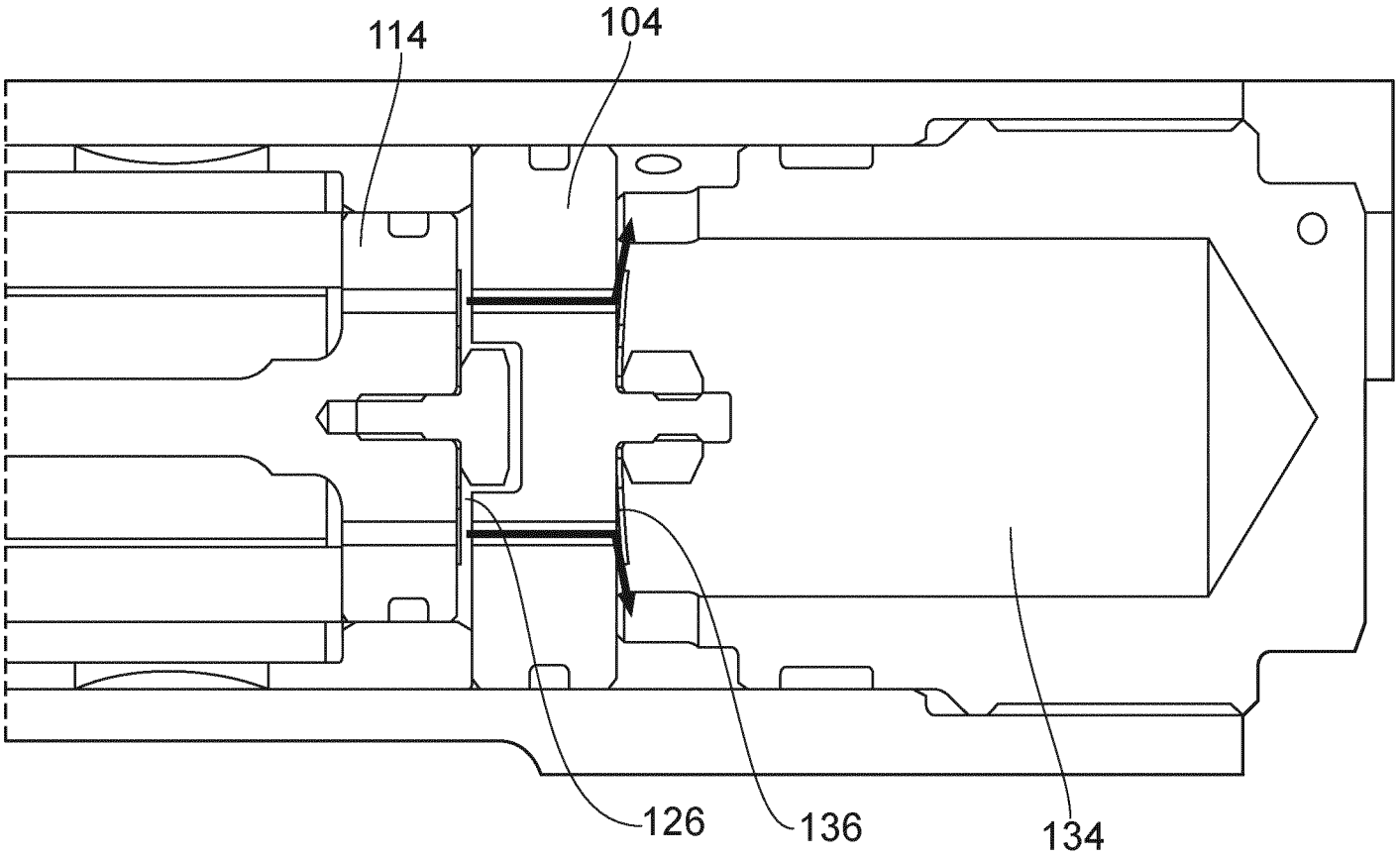

FIG. 5 illustrates the pump 100 when the piezo-electric stack is partially extended, i.e. the stack is now being driven in the opposite sense to the FIG. 3. This represents the pump partway through an outlet stroke. The relative movement of the piston head 114 towards the outlet plate 104 reduces the volume of the pumping chamber 126, increasing the pressure within the chamber thereby causing fluid to flow from the pumping chamber through the outlet passages 132, as indicated by the arrows. The pressure difference between fluid within the pumping chamber and lower pressure in the outlet chamber 134 is sufficient to overcome the bias force of the outlet disc valve 136, as illustrated, allowing the fluid to flow past the deformed disc valve into the fluid outlet chamber 134. During this period the inlet disc valve 130 will tend to be closed and will prevent the fluid flowing from the pumping chamber through the inlet passages 128 back into the stack void 112.

The movement of the piezo-electric stack 106 between the positions illustrated in FIGS. 2-5 (and back to the position of FIG. 2) constitutes a complete working cycle of the pump. As previously noted, to achieve the desired fluid flow rate, such as 0.5 litres/min, the piezo-electric stack must be driven at a relatively high frequency, such as 1000-1400 Hz. In some circumstances the piezoelectric stack may be driven at up to 2000 Hz. At these frequencies of operation the stack is highly likely to generate an undesirable amount of heat (due to inherent energy conversion losses in the piezo-electric material). However, by utilising a hollow piezo-electric stack as illustrated, the flow of fluid through the interior of the piezo-electric stack during operation of the pump provides a degree of cooling.

As also previously noted, operating the piezo-electric stack under a tensile load at the above mentioned frequencies is undesirable. This is overcome by use of the Belleville washers 122, which allow the piezo-electric stack 106 to be held in compression between the piston head 114 and the base plate 118 at all times, whilst still allowing the stack to extend and retract. The Belleville washers may be replaced with any other suitable resilient element, such as a coil spring, but the Belleville washers have the advantage of providing a relatively high spring force for their overall size and displacement. Pre-loading the piezo stack with a Belleville washer can also increase the pressure capability of the pump by operating within the region of the Belleville washer spring curve characteristic where force is constant over displacement. Other mechanisms for pre-loading the piezo-electric stack may however be used, such as providing a spring or bellows around the outside of the stack and connected between the piston head 114 and the base plate 118 such that the spring tension acting on the piston head and base plate exerts a compressive force on the intervening stack elements.

To avoid any compressibility effects arising from the pumped fluid, and because the displacement of the piezo-electric stack is inherently small (of the order of sub-millimetre), the volume of the pumping chamber is kept to a minimum. For example, the pumping chamber volume may be of the order of 0.7 mL, with a length of 1 mm. The overall length of the piezo-electric stack for such a pumping chamber volume will be of the order of 60-70 mm. The dimensions are provided purely as an aid to understanding the scale of the pump and are not necessarily desired or preferred dimensions.

The high frequency operation required to accumulate very small pumped volumes into appreciable flows requires responsive valves. The dynamic capability of inlet and outlet disc valves meet this requirement. Additionally, the incorporation of the low profile inlet disc valve onto the piston head minimises the pumping chamber volume resulting in a higher pressure capability, as discussed above.

The combination of features (flow of pumped fluid through the hollow piezo-electric stack for cooling, pre-loading of the piezo-electric stack, and use of inlet and outlet disc valves) enables the piezo-electric pump described above to exhibit substantial improvements to the pressure and flow capability compared to other piezo-electric pumps. As a result, possible aircraft applications for such an improved piezo-electric pump include (but are not limited to) landing gear up-locks, lock-stays, gear door actuators, and brake and steering actuators, engines bleed valves, and aircraft environmental systems.

The invention claimed is:

1. A piezo-electric hydraulic fluid pump comprising:

a main housing including a hydraulic fluid inlet port;

a hydraulic fluid reservoir located within the main housing;

a piston head moveably mounted within the main housing;

a piezo-electric stack located within the main housing, wherein the piezo-electric stack includes an internal void that comprises the hydraulic fluid reservoir, the internal void being in fluid communication with the hydraulic fluid inlet port in the main housing;

a piston rod coupled to the piston head, wherein the piston rod extends from the piston head through the reservoir;

a bias mechanism arranged to couple the piston head and piezo-electric stack and maintain the piezo-electric stack in compression;

an outlet plate statically mounted within the main housing adjacent to the piston head, wherein the adjacent surfaces of the outlet plate and piston head define a pumping chamber;

an inlet disc valve arranged to permit a one-way flow of hydraulic fluid from the reservoir into the pumping chamber; and an outlet disc valve arranged to permit a one-way flow of hydraulic fluid out of the pumping chamber;

wherein the internal void is in fluid communication with the hydraulic fluid inlet port in the main housing to enable working fluid entering the hydraulic fluid inlet port to contact the piezo-electric stack.

2. The piezo-electric hydraulic fluid pump according to claim 1, wherein the piezo-electric stack is located between the piston head and a base plate and the bias mechanism comprises a spring element arranged to exert a force biasing the piston head and base plate towards each other.

3. The piezo-electric hydraulic fluid pump according to claim 2, wherein the piston rod is coupled to the base plate.

4. The piezo-electric hydraulic fluid pump according to claim 3, wherein the piston rod is coupled to the base plate by one or more retaining elements and the spring element is located between the retaining elements and the base plate.

5. The piezo-electric hydraulic fluid pump according to claim 4, wherein the spring element comprises one or more Belleville washers.

6. The piezo electric hydraulic fluid pump according to claim 2, wherein the spring element is arranged around the outside of the piezo-electric stack and is coupled to the piston head and the base plate.

7. The piezo-electric hydraulic fluid pump according to claim 1, further comprising a fluid inlet port in fluid communication with the fluid reservoir.

8. The piezo-electric hydraulic fluid pump according to claim 1, wherein at least one or more fluid inlet passages are formed in the piston head providing fluid communication between the fluid reservoir and the pumping chamber and the inlet disc valve is arranged to prevent fluid flow from the pumping chamber into the at least one or more fluid inlet passages.

9. The piezo-electric hydraulic fluid pump according to claim 1, wherein at least one or more fluid outlet passages are formed in the outlet plate providing fluid communication out of the pumping chamber into a fluid outlet chamber and the outlet disc valve is arranged to prevent fluid flow from the fluid outlet chamber into the at least one or more fluid outlet passages.

10. A piezo-electric hydraulic fluid pump comprising:

a main housing including a hydraulic fluid inlet port;

a hydraulic fluid reservoir located within the main housing;

a piston head moveably mounted within the main housing;

a piezo-electric stack located within the main housing, wherein the piezo-electric stack includes an internal void that comprises the hydraulic fluid reservoir, the internal void being in fluid communication with the hydraulic fluid inlet port in the main housing;

a piston rod coupled to the piston head, wherein the piston rod extends from the piston head through the reservoir;

a bias mechanism arranged to couple the piston head and piezo-electric stack and maintain the piezo-electric stack in compression;

an outlet plate statically mounted within the main housing adjacent to the piston head, wherein the adjacent surfaces of the outlet plate and piston head define a pumping chamber;

an inlet disc valve arranged to permit a one-way flow of hydraulic fluid from the reservoir into the pumping chamber; and an outlet disc valve arranged to permit a one-way flow of hydraulic fluid out of the pumping chamber, wherein all free space within the internal void is in fluid communication with the hydraulic fluid inlet port.

11. A piezo-electric hydraulic fluid pump comprising:

a main housing including a hydraulic fluid inlet port;

a hydraulic fluid reservoir located within the main housing;

a piston head moveably mounted within the main housing;

a piezo-electric stack located within the main housing, wherein the piezo-electric stack includes an internal void that comprises the hydraulic fluid reservoir, the internal void being in fluid communication with the hydraulic fluid inlet port in the main housing;

a piston rod coupled to the piston head, wherein the piston rod extends from the piston head through the reservoir;

a bias mechanism arranged to couple the piston head and piezo-electric stack and maintain the piezo-electric stack in compression;

an outlet plate statically mounted within the main housing adjacent to the piston head, wherein the adjacent surfaces of the outlet plate and piston head define a pumping chamber;

an inlet disc valve arranged to permit a one-way flow of hydraulic fluid from the reservoir into the pumping chamber; and an outlet disc valve arranged to permit a one-way flow of hydraulic fluid out of the pumping chamber, wherein the hydraulic fluid inlet port is arranged and configured to enable passage of working fluid entering the hydraulic fluid inlet port to contact the piezo-electric stack.

12. A piezo-electric hydraulic fluid pump comprising:

a main housing including a hydraulic fluid inlet port;

a hydraulic fluid reservoir located within the main housing;

a piston head moveably mounted within the main housing;

a piezo-electric stack located within the main housing, wherein the piezo-electric stack includes an internal void that comprises the hydraulic fluid reservoir, the internal void being in fluid communication with the hydraulic fluid inlet port in the main housing;

a piston rod coupled to the piston head, wherein the piston rod extends from the piston head through the reservoir;

a bias mechanism arranged to couple the piston head and piezo-electric stack and maintain the piezo-electric stack in compression;

an outlet plate statically mounted within the main housing adjacent to the piston head, wherein the adjacent surfaces of the outlet plate and piston head define a pumping chamber;

an inlet disc valve arranged to permit a one-way flow of hydraulic fluid from the reservoir into the pumping chamber; and an outlet disc valve arranged to permit a one-way flow of hydraulic fluid out of the pumping chamber, wherein the hydraulic fluid inlet port is arranged in fluid communication with an outer surface of the piezo-electric stack.

* * * * *